US007225600B2

(12) United States Patent
Spatafora

(10) Patent No.: US 7,225,600 B2
(45) Date of Patent: Jun. 5, 2007

(54) METHOD OF PRODUCING A HINGED-LID PACKET OF CIGARETTES

(75) Inventor: Mario Spatafora, Bologna (IT)

(73) Assignee: G.D Societa' per Azioni, Bologna (IL)

( * ) Notice: Subject to any disclaimer, the term of this patent is extended or adjusted under 35 U.S.C. 154(b) by 0 days.

(21) Appl. No.: 10/542,384

(22) PCT Filed: Dec. 30, 2003

(86) PCT No.: PCT/EP03/51116

§ 371 (c)(1),
(2), (4) Date: Dec. 22, 2005

(87) PCT Pub. No.: WO2004/063015

PCT Pub. Date: Jul. 29, 2004

(65) Prior Publication Data

US 2006/0101790 A1 May 18, 2006

(30) Foreign Application Priority Data

Jan. 14, 2003 (IT) ..... BO200300A14

(51) Int. Cl.
*B65B 19/22* (2006.01)

(52) U.S. Cl. ..... 53/449

(58) Field of Classification Search ..... 53/462, 53/207

See application file for complete search history.

(56) References Cited

U.S. PATENT DOCUMENTS

| | | | | |
|---|---|---|---|---|
| 2,776,608 | A * | 1/1957 | Fischer et al. | 493/110 |
| 3,361,326 | A * | 1/1968 | Croley et al. | 229/192 |
| 4,487,596 | A * | 12/1984 | Livens et al. | 493/125 |
| 5,092,107 | A * | 3/1992 | Lamm | 53/449 |
| 5,152,737 | A * | 10/1992 | Wu et al. | 493/352 |
| 6,015,084 | A * | 1/2000 | Mathieu et al. | 229/122.32 |
| 6,244,435 | B1 | 6/2001 | Cho | |
| 7,111,441 | B2 * | 9/2006 | Spatafora | 53/462 |

FOREIGN PATENT DOCUMENTS

| | | |
|---|---|---|
| CH | 405 911 A | 1/1966 |
| EP | 0 414 532 A1 | 2/1991 |

* cited by examiner

*Primary Examiner*—John Sipos
(74) *Attorney, Agent, or Firm*—Birch, Stewart, Kolasch & Birch, LLP

(57) ABSTRACT

A method of producing a hinged-lid packet of cigarettes having an inner wrapping formed by folding a first blank of foil about a group of cigarettes: an outer package formed from a second blank folded about the inner wrapping to define a body and a lid hinged to each other; and a collar formed by folding a third blank and interposed between the inner wrapping and the outer package; the method including the steps of juxtaposing and connecting the third blank to the first blank in laterally offset mutual positions; forming on the first blank fold lines located as a function of the aforementioned mutual positions; and simultaneously folding the first and third blank about the group of cigarettes.

5 Claims, 3 Drawing Sheets

METHOD OF PRODUCING A HINGED-LID PACKET OF CIGARETTES

The present invention relates to a method of producing a hinged-lid packet of cigarettes.

The present invention is particularly suitable for producing hinged-lid packets of cigarettes having bevelled or rounded longitudinal edges, or a cross section with no edges, such as an at least partly circular or oval section.

The normal way of producing packets of this type—which comprises forming a foil inner wrapping about a group of cigarettes, applying and retaining a collar of cardboard or similar on the inner wrapping, and forming an outer package of cardboard or similar about the whole so formed—has various drawbacks, due to the difficulty normally encountered, for lack of square reference edges, in keeping the collar in position on the inner wrapping when forming the outer package.

CH-405911-A discloses a machine for producing folded hinged-lid boxes, in which a cardboard collar for a box is cut from a web and is sealed to the bag web prior to the bag web being cut into bag lengths and folded around a mandrel around which a box blank is sub-sequently folded. The cardboard web is cut whilst held between elements and is immediately tacked by a heating device to the web prior to the final sealing along either edge by the die and sealing members. The bag blanks are folded around the mandrel by an upward movable folding tool and the longitudinal seam formed by sealing tools. The mandrels carried on an intermittently rotatable wheel are rebated at the collar ends at by amounts corresponding to the width and depth of the cardboard strips. The bag is closed at the collar end by a seam making two triangular corner folds.

It is an object of the present invention to provide a method which not only eliminates the aforementioned drawbacks in a straightforward, low-cost manner, but also simplifies formation of the inner wrapping, which is also problematic in the absence of square longitudinal edges.

According to the present invention, there is provided a method of producing a hinged-lid packet as recited in the attached claims.

A non-limiting embodiment of the present invention will be described by way of example with reference to the accompanying drawings, in which.

Figure 1:
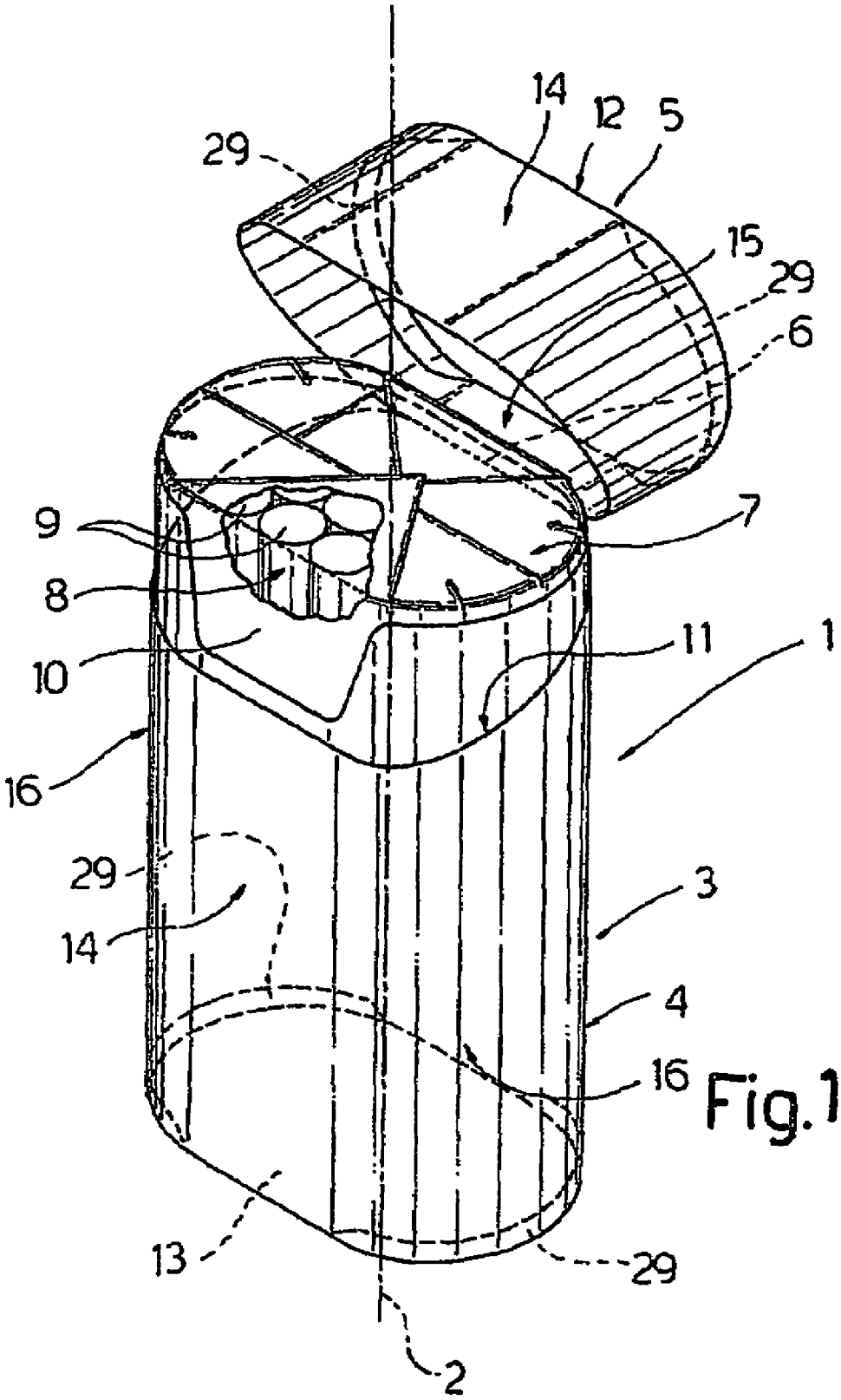
FIG. 1 shows a view in perspective, with parts removed for clarity, of a hinged-lid packet produced using the method according to the present invention.

Number 1 in FIG. 1 indicates as a whole a hinged-lid packet 1 of cigarettes having a longitudinal axis 2, and comprising an outer package 3 made of cardboard or similar and defined by a body 4, and by a lid 5 hinged to body 4 along a hinge 6, crosswise to axis 2, to move, with respect to body 4, between an open position and a closed position (not shown). Packet 1 also comprises a foil inner wrapping 7 containing a group 8 of cigarettes 9; and a collar 10 interposed between outer package 3 and inner wrapping 7, and projecting partly from an opening 11, in body 4, closed by lid 5 in the closed position.

Packet 1 is defined, at opposite axial ends, by a top wall 12 of lid 5 and a bottom wall 13 of body 4, both substantially in the form of a flat oval, and comprises a lateral wall extending to both body 4 and lid 5, and in turn comprising a longitudinal front strip 14 and a longitudinal rear strip 15, which are parallel and substantially flat, and two opposite longitudinal curved strips 16 connecting the two front and rear strips 14 and 15.

Figure 2:
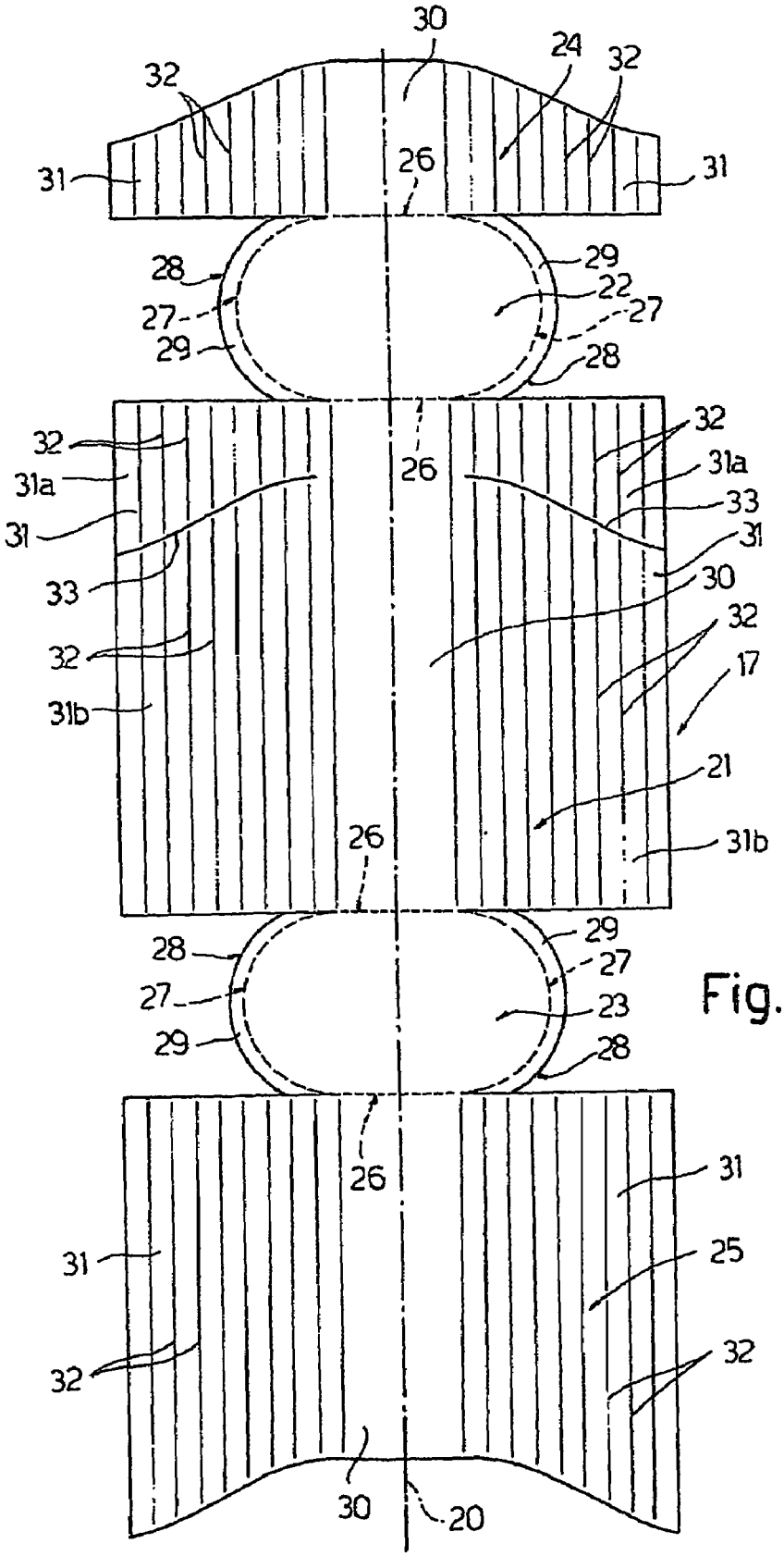
FIG. 2 shows a flat blank by which to produce an outer package of the FIG. 1 packet.
Figure 3:
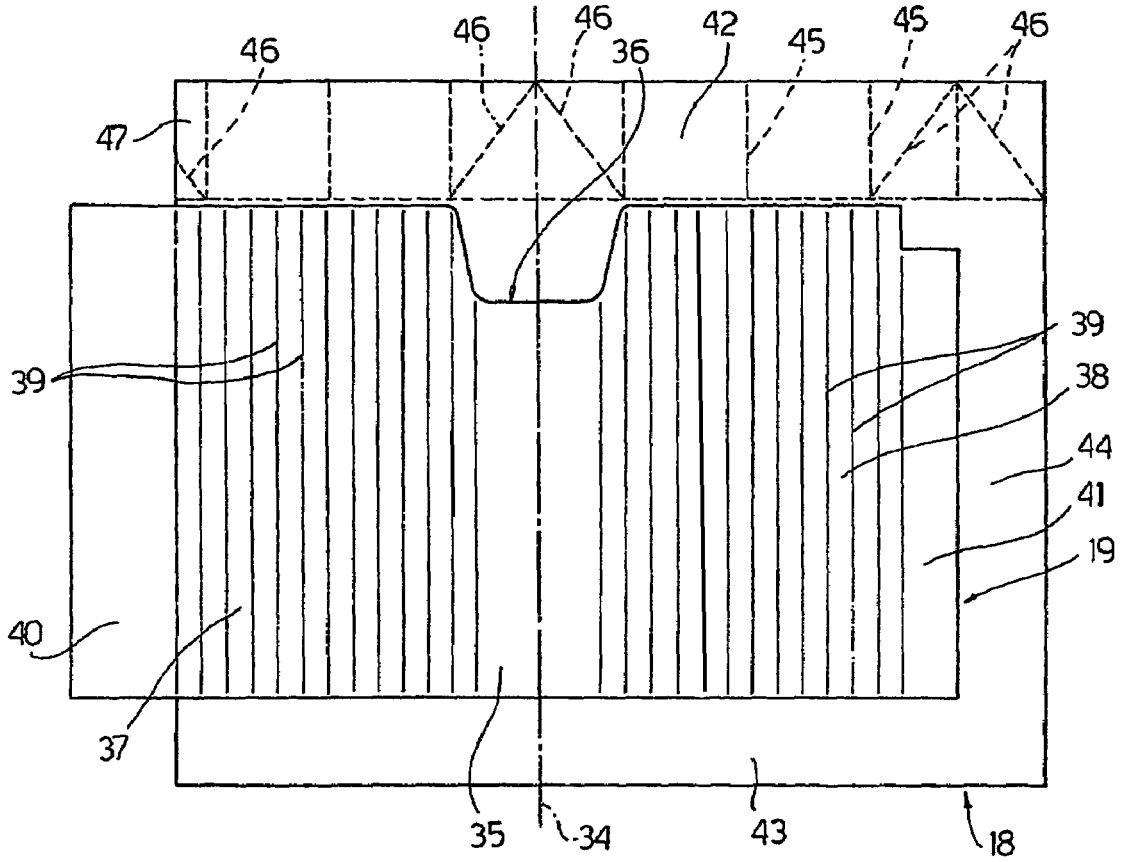
FIG. 3 shows two superimposed flat blanks for producing an inner wrapping and a collar of the FIG. 1 packet.

As shown in FIGS. 2 and 3, outer package 3, inner wrapping 7, and collar 10 are formed by folding respective flat blanks 17, 18 and 19.

As shown in FIG. 2, blank 17 is substantially in the form of an elongated rectangle, extends along a longitudinal axis 20, and comprises, aligned along axis 20, a central panel 21; two intermediate panels 22 and 23; an end panel 24 connected to central panel 21 with the interposition of intermediate panel 22; and an end panel 25 connected to central panel 21 with the interposition of intermediate panel 23.

The two intermediate panels 22, 23 are substantially identical, and each is substantially in the form of a flat oval, and is connected to the respective adjacent panels 24,21; 25,21 along two pre-weakened straight portions 26 of its perimeter, which are crosswise to axis 20 and connected to each other at the ends by two pre-weakened curved portions 27, which are positioned with their concavities facing each other and axis 20, and define, with straight portions 26, the contour of a respective wall 12, 13. Each of the two curved portions 27 extends inwards of a respective curved edge 28 of respective intermediate panel 22, 23 to define, with relative curved edge 28, a curved rim 29, which is folded squarely in known manner by drawing relative intermediate panel 22, 23.

Each panel 21, 24, 25 comprises a longitudinal central portion 30 of the same size as straight portions 26 and defining, with the other central portions 30, front and rear strips 14 and 15; and two longitudinal lateral portions 31 located on opposite sides of relative central portion 30, and along which extend longitudinal crease lines 32.

Once each intermediate panel 22, 23 is folded squarely with respect to the adjacent panels, each lateral portion 31 of each of the two end panels 24, 25 is folded onto the relative curved rim 29 and relative lateral portion 31 of central panel 21 to define relative curved strip 16 of packet 1. More specifically, each lateral portion 31 of central panel 21 is divided into a lid portion 31*a* and a body portion 31*b* by a respective cut line 33 substantially crosswise to axis 20 and connected to the other cut line 33 by a pre-weakened line defining hinge 6. Lid portion 31*a* is superimposed on respective lateral portion 31 of end panel 24, and is connected to relative curved rim 29 of intermediate panel 22 to define a lid portion of relative curved strip 16; while body portion 31*b* is superimposed on respective lateral portion 31 of end panel 25, and is connected to relative curved rim 29 of intermediate panel 23 to define a body portion of relative curved strip 16.

As shown in FIG. 3, blank 19 is substantially rectangular with its major axis crosswise to a longitudinal axis 34, and comprises a central face 35 coaxial with axis 34 and having a recess 36 at one end; and two identical lateral portions 37 and 38 located on opposite sides of central face 35, and along which extend respective crease lines 39 parallel to axis 34. Lateral portion 37 is defined outwards by a flap 40 parallel to axis 34 and extending, in the direction of axis 34, along the full height of lateral portion 37; while lateral portion 38 is defined outwards by a flap 41 parallel to axis 34, narrower than flap 40, and extending, in the direction of axis 34, along only part of the height of lateral portion 38.

As shown in FIG. 3, blank 18 is defined by a rectangular sheet of foil higher than and of substantially the same width as blank 19.

When producing packet 1, blank 19 is superimposed on, and possibly glued to, blank 18 in a substantially central position heightwise, but offset transversely, so that the whole of flap 40 projects laterally with respect to blank 18, and so as to define, on blank 18, two strips 42 and 43 crosswise to axis 34 at opposite ends of blank 19, with strip 42 adjacent to recess 36, and a longitudinal strip 44 projecting outwards of flap 41.

A known tool, not shown, then forms on strip 42 a number of fold lines 45 parallel to longitudinal axis 34; and a number of oblique fold lines 46, which are located along strip 42 as a function of the offset position of the two blanks 18 and 19, to close the end of inner wrapping 7 more easily, by folding strip 42 into segments (FIG. 1), once blanks 18 and 19 are folded about group 8 to form a tubular package not shown.

In connection with the above, it should be pointed out that said tubular package is formed by superimposing longitudinal strip 44 of blank 18 on the inside of an opposite longitudinal strip 47 of blank 18; superimposing flap 41 on the inside of flap 40; and gluing flaps 40 and 41 together; and that formation of the tubular package is assisted by the transversely offset position of blanks 18 and 19, which eliminates the drawback of gripping strips 44 and 47 between flaps 40 and 41, and enables flaps 40 and 41 to be glued together. This therefore provides for achieving a relatively stable shape of both tubular inner wrapping 7 and tubular collar 10, and for preventing collar 10 from slipping transversely with respect to inner wrapping 7 when forming outer package 3.

In connection with the above, it should also be pointed out that superimposing blanks 18 and 19 beforehand in the specific position described above provides for accurately forming fold lines 45 and 46, the position of which is a function of the relative position of collar 10 and inner wrapping 7; and that folding blanks 18 and 19 simultaneously to obtain inner wrapping 7 and relative collar 10 greatly simplifies production of packet 1.

The invention claimed is:

1. A method of producing a hinged-lid packet of cigarettes; the method comprising the steps of:

folding a first blank (18) of foil about a group (8) of cigarettes (9) for forming an inner wrapping (7);

folding a second blank (17) about the inner wrapping (7) to define a body (4) and a lid (5) hinged to each other and for forming an outer package (3);

folding a third blank (19) for forming a collar (10), which is interposed between the inner wrapping (7) and the outer package (3) and projects from the body (4) to engage the lid (5);

juxtaposing the third blank (19) and the first blank (18) in a given superimposed position; and simultaneously folding the first and the third blank (18, 19) about the group (8) of cigarettes (9);

the method being characterized in that both the inner wrapping (7) and the collar (10) are tubular, and the given superimposed position is a transversely offset position, wherein a first lateral portion (40) of the third blank (19) projects laterally with respect to the first blank (18), and a second lateral portion (44) of the first blank (18) projects laterally with respect to the third blank (19) on the opposite side of the third blank (19) to the first lateral portion (40).

2. A method as claimed in claim 1, wherein the first and the third blank (18, 19) are connected to each other in the given superimposed position.

3. A method as claimed in claim 1, wherein the first blank (18) is folded along fold lines (45, 46) formed after the first blank (18) is positioned in the given superimposed position with respect to the third blank (19).

4. A method as claimed in claim 3, wherein the fold lines (45, 46) are located on the first blank (18) as a function of the given superimposed position.

5. A method as claimed in claim 1, wherein the first and the third blank (18, 19) are folded simultaneously into a tube, and are stabilized by connecting the first and the second lateral portion (40, 44) to laterally opposite portions (41, 47) of the third blank (19) and first blank (18) respectively.

* * * * *

UNITED STATES PATENT AND TRADEMARK OFFICE

CERTIFICATE OF CORRECTION

PATENT NO. : 7,225,600 B2
APPLICATION NO. : 10/542384
DATED : June 5, 2007
INVENTOR(S) : Mario Spatafora It is certified that error appears in the above-identified patent and that said Letters Patent is hereby corrected as shown below:

Title Page
Item (30) Foreign Application Priority Data:
"Jan. 14, 2003 (IT) .....B0200300A14" should be
--Jan. 14, 2003 (IT) .....B0200300A000014--

Title page Item (73) Assignee:
"G.D Societa' per Azioni, Bologna (IL)" should be
--G.D. Societa' per Azioni, Bologna (IT)--.

Signed and Sealed this

Sixth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,225,600 B2
APPLICATION NO. : 10/542384
DATED : June 5, 2007
INVENTOR(S) : Mario Spatafora It is certified that error appears in the above-identified patent and that said Letters Patent is hereby corrected as shown below:

Title Page, Item (73), Assignee:

"G.D. Societa' per Azioni, Bologna (IT)" should read --G.D Societa' per Azioni (IT)--.

Title Page, Item (30), Foreign Application Priority Data:

"Jan. 14, 2003 (IT).....B0200300A000014" should read

--Jan 14, 2003 (IT).....BO2003A000014--.

Signed and Sealed this

Fourteenth Day of September, 2010

David J. Kappos

David J. Kappos
*Director of the United States Patent and Trademark Office*